US012480525B2

(12) United States Patent
Su et al.

(10) Patent No.: US 12,480,525 B2
(45) Date of Patent: Nov. 25, 2025

(54) IMPELLER AND DIAGONAL FAN INCLUDING THE SAME

(71) Applicant: DELTA ELECTRONICS, INC., Taoyuan (TW)

(72) Inventors: Sheng-Chieh Su, Taoyuan (TW); Pei-Han Chiu, Taoyuan (TW); Chien-Ming Lee, Taoyuan (TW); Chung-Yuan Tsang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/770,669

(22) Filed: Jul. 12, 2024

(65) Prior Publication Data

US 2025/0020138 A1 Jan. 16, 2025

Related U.S. Application Data

(60) Provisional application No. 63/526,273, filed on Jul. 12, 2023.

(51) Int. Cl.

| | |
|---|---|
| ***F04D 29/32*** | (2006.01) |
| ***F04D 29/44*** | (2006.01) |
| ***F04D 29/66*** | (2006.01) |

(52) U.S. Cl.
CPC ..... *F04D 29/326* (2013.01); *F04D 29/444* (2013.01); *F04D 29/661* (2013.01)

(58) Field of Classification Search
CPC ..... F04D 29/326; F04D 29/444; F04D 29/661
See application file for complete search history.

(56) References Cited

U.S. PATENT DOCUMENTS

| | | | | |
|---|---|---|---|---|
| 3,751,178 | A * | 8/1973 | Paugh | F04D 1/06 415/199.1 |
| 5,169,286 | A * | 12/1992 | Yamada | F04D 15/0038 415/48 |
| 5,545,006 | A * | 8/1996 | Agahi | F04D 17/12 415/199.1 |
| 7,600,961 | B2 * | 10/2009 | Abdallah | F04D 25/045 415/58.4 |
| 8,475,111 | B2 | 7/2013 | Stagg et al. | |
| 9,074,608 | B2 * | 7/2015 | Bertels | F04D 29/2222 |
| 9,404,502 | B2 | 8/2016 | Ishikawa | |
| 11,428,238 | B2 | 8/2022 | Haaf et al. | |
| 11,971,050 | B2 * | 4/2024 | Kilchyk | F04D 27/0246 |
| 12,129,859 | B1 * | 10/2024 | Gattu | F04D 29/444 |

(Continued)

FOREIGN PATENT DOCUMENTS

| | | | |
|---|---|---|---|
| CN | 1940307 | A | 4/2007 |
| CN | 104005993 | A | 8/2014 |

(Continued)

*Primary Examiner* — Andrew J Marien
(74) *Attorney, Agent, or Firm* — CKC & Partners Co., LLC

(57) ABSTRACT

An impeller for a diagonal fan includes a hub, a cylindrical part, a conical section shell, a plurality of blades and a plurality of extended blades. The cylindrical part is connected to the hub and extends axially from a lower end of the hub. The conical section shell surrounds the hub. The blades are connected to the hub and an inner surface of the conical section shell. The extended blades are disposed on an outer surface of the conical section shell and project from the outer surface of the conical section shell.

19 Claims, 14 Drawing Sheets

(56) References Cited

U.S. PATENT DOCUMENTS

| | | | | |
|---|---|---|---|---|
| 2003/0012653 | A1* | 1/2003 | Diemunsch | F04D 29/326<br>416/189 |
| 2008/0279681 | A1* | 11/2008 | Eguchi | F04D 29/444<br>415/206 |
| 2021/0277910 | A1 | 9/2021 | Heli et al. | |
| 2021/0364011 | A1 | 11/2021 | Gebert et al. | |
| 2023/0033024 | A1 | 2/2023 | Chiu et al. | |
| 2024/0229814 | A1* | 7/2024 | Corralejo Anton | F04D 29/4213 |

FOREIGN PATENT DOCUMENTS

| | | | |
|---|---|---|---|
| CN | 105179271 | A | 12/2015 |
| CN | 107061324 | A | 8/2017 |
| CN | 209041173 | U | 6/2019 |
| CN | 217518915 | U | 9/2022 |
| CN | 115681179 | A | 2/2023 |
| DE | 202016106538 | U1 | 12/2016 |
| KR | 20140037578 | A | 3/2014 |

* cited by examiner

90 { 91, 92, 93, 94 }

90A { 91, 92, 93, 94A }

IMPELLER AND DIAGONAL FAN INCLUDING THE SAME

RELATED APPLICATIONS

This application claims priority to U.S. Provisional Application Ser. No. 63/526,273, filed Jul. 12, 2023, which is herein incorporated by reference in its entirety.

BACKGROUND

Technical Field

The present disclosure relates to an impeller and a diagonal fan including the impeller.

Description of Related Art

Cooling fans can create airflow that causes the heat source to dissipate heat at an accelerated pace. As technology advances, the computational power of electronic devices continues to grow. However, the amount of heat generated by electronic devices has increased as well. Hence, mechanical engineers aim to design cooling fans with increased efficiency and reduced noise level.

SUMMARY

An aspect of the disclosure is to provide an impeller and a diagonal fan with increased efficiency and reduced noise level.

In accordance with an embodiment of the present disclosure, an impeller includes a hub, a cylindrical part, a conical section shell, a plurality of blades and a plurality of extended blades. The cylindrical part is connected to the hub and extends axially from a lower end of the hub. The conical section shell surrounds the hub. The blades are connected to the hub and an inner surface of the conical section shell. The extended blades are disposed on an outer surface of the conical section shell and project from the outer surface of the conical section shell.

In one or more embodiments of the present disclosure, the conical section shell includes a first rim and a second rim. The first rim and the second rim are provided on opposite sides of the conical section shell. Each of the extended blades extends from the first rim to the second rim, and two ends of each of the extended blades are joined with the first rim and the second rim, respectively.

In one or more embodiments of the present disclosure, the impeller includes an equal number of blades and extended blades, and each of the extended blades is aligned with one of the blades.

In one or more embodiments of the present disclosure, the extended blades include a first extended blade, and the blades include a first blade aligned with the first extended blade. The first extended blade is an extension of the first blade.

In one or more embodiments of the present disclosure, the extended blades include a first extended blade, and the blades include a first blade. The first extended blade and the first blade have the same slope.

In one or more embodiments of the present disclosure, the blades and the extended blades are misaligned.

In one or more embodiments of the present disclosure, the extended blades include a first extended blade, and the blades include a first blade. The first extended blade and the first blade have the same slope, and the first extended blade is at an offset to the first blade.

In one or more embodiments of the present disclosure, the impeller includes a different number of extended blades and blades.

In one or more embodiments of the present disclosure, the extended blades include a first extended blade, and the blades include a first blade. The first extended blade and the first blade have different slopes.

In one or more embodiments of the present disclosure, the conical section shell includes a rim. The rim is located at a lower end of the conical section shell, and the rim has a circular contour line.

In one or more embodiments of the present disclosure, the conical section shell includes a rim. The rim is located at a lower end of the conical section shell, and the rim has a contour line formed by a number of arcs connected together.

In accordance with an embodiment of the present disclosure, a diagonal fan includes a frame and an impeller. The frame has an accommodation space, an inlet and an outlet. The impeller is disposed in the accommodation space and located between the inlet and the outlet. The impeller includes a hub, a cylindrical part, a conical section shell, a plurality of blades and a plurality of extended blades. The cylindrical part is connected to the hub and extends axially from a lower end of the hub. The conical section shell surrounds the hub. The blades are connected to the hub and an inner surface of the conical section shell. The extended blades are disposed on an outer surface of the conical section shell and project from the outer surface of the conical section shell. A backflow channel is created between the conical section shell and an inner surface of the frame. The extended blades partially block the backflow channel.

In one or more embodiments of the present disclosure, a first distance between the inner surface of the frame and an outer contour of each of the extended blades is constant.

In one or more embodiments of the present disclosure, a second distance between a lower end of the conical section shell and the inner surface of the frame is constant. A third distance between an upper end of the conical section shell and the inner surface of the frame is constant. The first distance is equal to the second distance and the third distance.

In one or more embodiments of the present disclosure, the frame includes a guiding wall. The guiding wall is arranged around the inlet and extends towards the accommodation space. A fourth distance between the upper end of the conical section shell and the guiding wall is constant and is equal to the first distance.

In one or more embodiments of the present disclosure, the inner surface of the frame has a curved region or a corner region facing the extended blades.

In sum, in the diagonal fan of the present disclosure, the conical section shell of the impeller is provided with one or more extended blades on its outer surface. The extended blades can obstruct backflow of air passing through the gap between the impeller and the frame of the fan. As a result, the efficiency of the diagonal fan is improved, and the noise produced by the diagonal fan can be reduced.

It is to be understood that both the foregoing general description and the following detailed description are by examples, and are intended to provide further explanation of the disclosure as claimed.

BRIEF DESCRIPTION OF THE DRAWINGS

To make the objectives, features, advantages, and embodiments of the present disclosure, including those mentioned above and others, more comprehensible, descriptions of the accompanying drawings are provided as follows.

DETAILED DESCRIPTION

Figure 1:
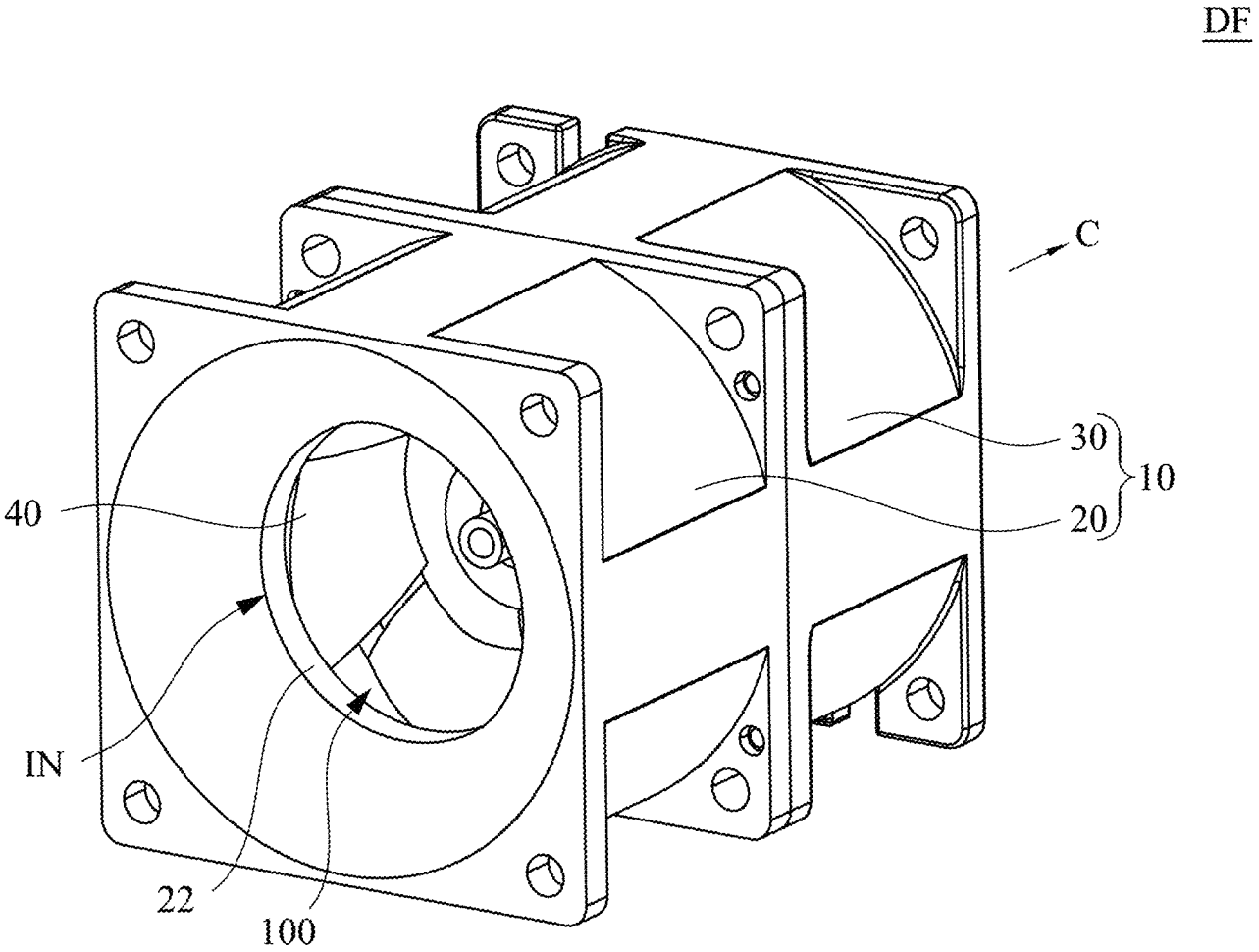
FIG. 1 illustrates a perspective view of a diagonal fan in accordance with an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Reference is made to FIG. 1. FIG. 1 illustrates a perspective view of a diagonal fan DF in accordance with an embodiment of the present disclosure. The diagonal fan DF includes a frame 10 and an impeller 40. The frame 10 has an accommodation space 100 and an inlet IN communicating with the accommodation space 100. The inlet IN is preferably circular. The impeller 40 is disposed in the accommodation space 100 and faces the inlet IN. When the impeller 40 is rotating, air is drawn into the accommodation space 100 through the inlet IN. In some embodiments, the frame 10 further includes a guiding wall 22 arranged around the inlet IN and extending towards the accommodation space 100. The guiding wall 22 can guide air to smoothly flow into the accommodation space 100. In some embodiments, the frame 10 includes a first frame 20 and a second frame 30 arranged along an axial direction C. The first frame 20 and the second frame 30 are combined to form the accommodation space 100. The first frame 20 has the inlet IN and the guiding wall 22.

Figure 2:
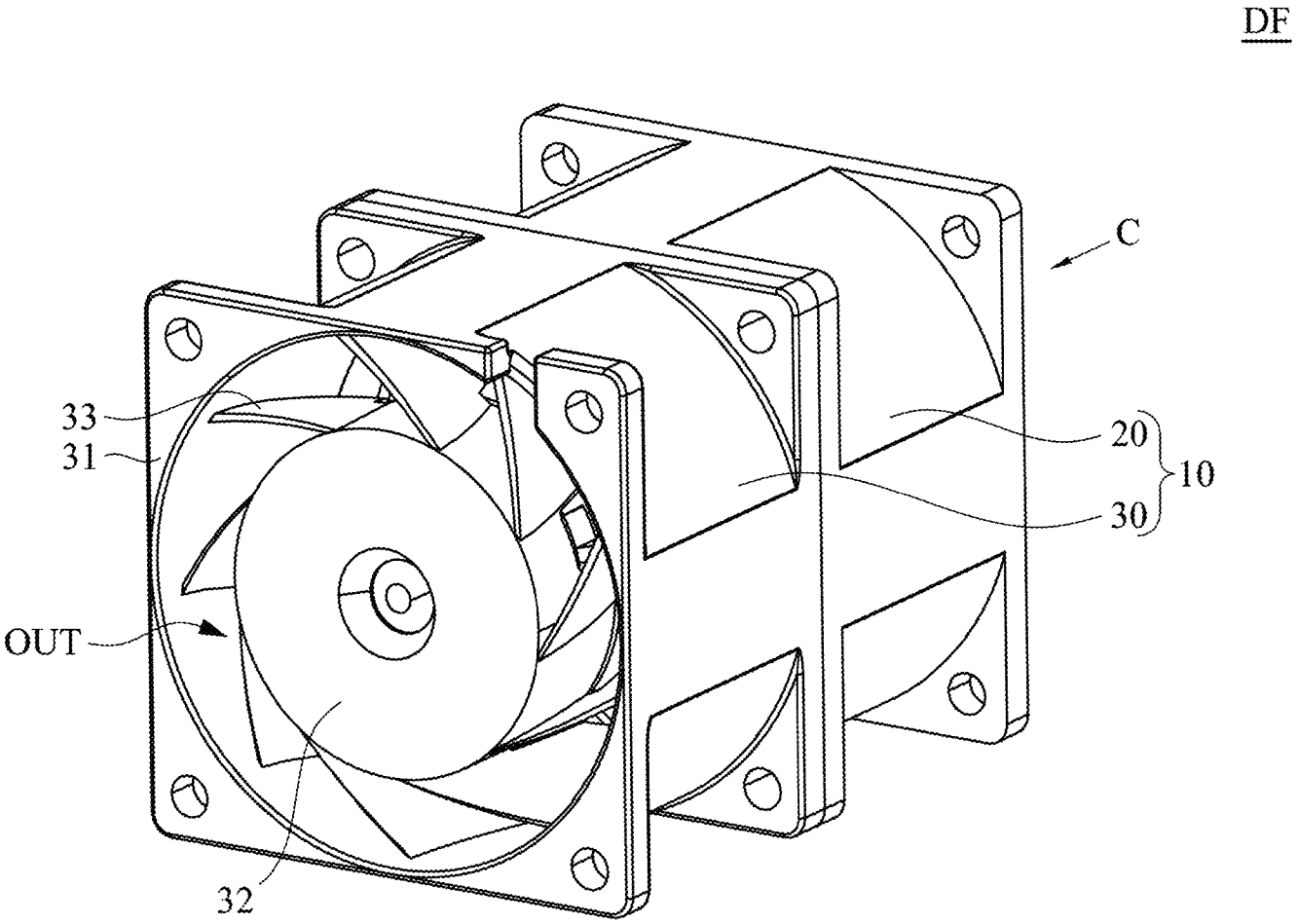
FIG. 2 illustrates a perspective view of the diagonal fan shown in FIG. 1 from an opposite view angle.

Reference is made to FIG. 2. FIG. 2 illustrates a perspective view of the diagonal fan DF shown in FIG. 1 from an opposite view angle. In some embodiments, the second frame 30 includes a plate 31, a base 32 and a plurality of static blades 33 forming an outlet OUT of the frame 10. The static blades 33 are disposed between the base 32 and the plate 31, and two ends of each of the static blades 33 are connected to the base 32 and the plate 31, respectively. When the impeller 40 is rotating, air is drawn into the accommodation space 100 through the inlet IN, and is discharged through the outlet OUT.

Figure 3:
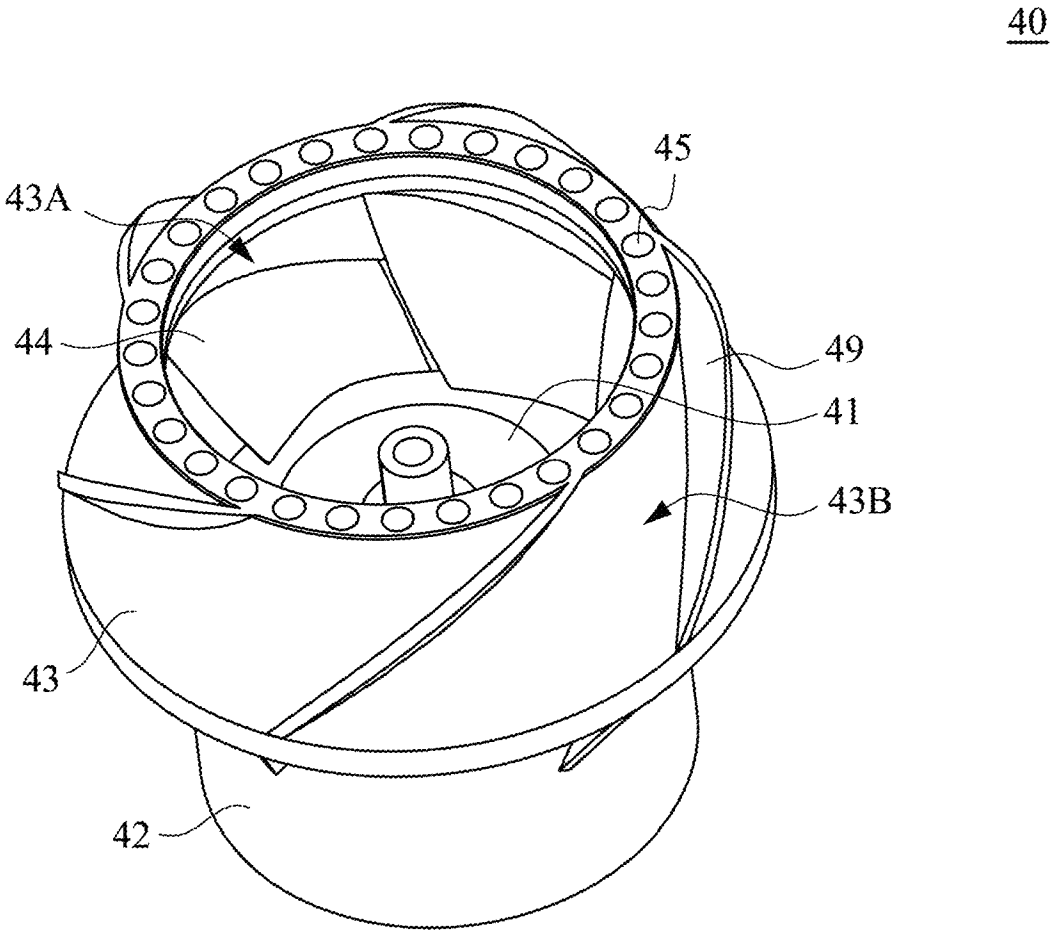
FIG. 3 illustrates a perspective view of an impeller disposed in the diagonal fan shown in FIG. 1.

Reference is made to FIG. 3. FIG. 3 illustrates a perspective view of the impeller shown in FIG. 1. The impeller 40 includes a hub 41, a cylindrical part 42, a conical section shell 43, a plurality of blades 44 (or inner blades) and a plurality of balance holes 45. The cylindrical part 42 is connected to the hub 41 and extends axially from a lower end of the hub 41. The conical section shell 43 surrounds the hub 41 and is placed concentrically with the hub 41. The blades 44 are arranged around the hub 41. Each of the blades 44 has an inner edge connected to the hub 41 and an outer edge connected to the conical section shell 43. Each of the blades 44 includes three-dimensionally curved surfaces. The balance holes 45 are provided on an upper surface of the conical section shell 43 for filling balancing weights and for the purpose of reducing vibration of the impeller 40 when the impeller 40 is rotating.

As shown in FIG. 3, the impeller 40 further includes one or more extended blades 49 disposed on the conical section shell 43. Specifically, the conical section shell 43 has an inner surface 43A and an outer surface 43B opposite to the inner surface 43A. The inner surface 43A and the outer surface 43B each have a curved shape. The blades 44 are connected to the inner surface 43A of the conical section shell 43, and the extended blades 49 are disposed on the outer surface 43B of the conical section shell 43. In other words, the extended blades 49 are raised structures formed on the outer surface 43B of the conical section shell 43. In the present embodiment, the impeller 40 includes five extended blades 49 and five blades 44. As will be explained below, the extended blades 49 can help reduce backflow of air in the diagonal fan DF. In some embodiments, the hub 41, the cylindrical part 42, the conical section shell 43, the blades 44 and the extended blades 49 are integrally formed by an injection molding process.

Figure 4:
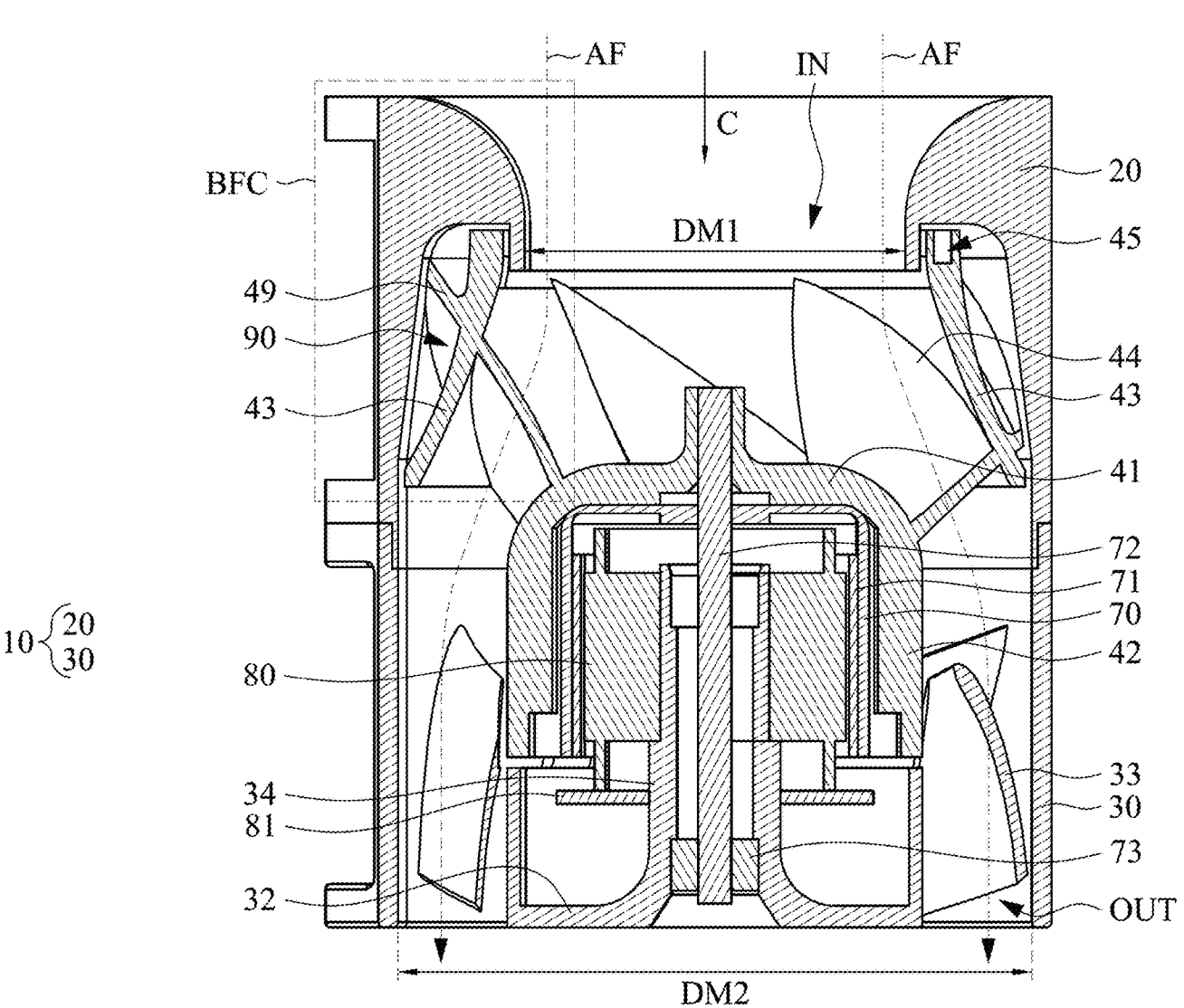
FIG. 4 illustrates a sectional view of the diagonal fan shown in FIG. 1.

Reference is made to FIG. 4. FIG. 4 illustrates a sectional view of the diagonal fan DF shown in FIG. 1. The base 32 of the second frame 30 includes a tube 34. The impeller 40 is driven by a motor. The motor includes a stator and a rotor. The stator includes a winding 80 and a printed circuit board (PCB) 81 disposed on a periphery of the tube 34. The rotor includes a magnetic shell 70, a magnet 71 and a shaft 72. The magnetic shell 70 is positioned inside the cylindrical part 42 of the impeller 40 and is connected to the shaft 72. The magnet 71 is disposed on an inner wall of the magnetic shell 70 and spatially corresponding to the winding 80. The shaft 72 is fixedly coupled to the hub 41 of the impeller 40. The shaft 72 passes through the center of the magnetic shell 70 and extends into the tube 34. The shaft 72 is rotatably coupled to the tube 34 via at least one bearing 73. The rotor and the stator are positioned between the impeller 40 and the second frame 30.

As shown in FIG. 4, the impeller 40 is located between the inlet IN and the outlet OUT. The upper end of the base 32 is spatially corresponding to a periphery of the cylindrical part 42. When the impeller 40 is rotating, an airflow AF from the inlet IN to the outlet OUT is created. The inlet IN and the outlet OUT are arranged along the axial direction C. The airflow AF enters the diagonal fan DF from the inlet IN, passes through the empty spaces between the blades 44 of the impeller 40, further passes through the empty spaces between the static blades 33 of the second frame 30, and exits the diagonal fan DF through the outlet OUT. Preferably, a diameter DM2 of the outlet OUT is greater than a diameter DM1 of the inlet IN, and the conical section shell 43 and the contour of the hub 41 are arranged to expand radially. As a result, the airflow AF can gradually expand as it passes through the impeller 40. In some embodiments, the conical section shell 43 extends obliquely, i.e., the conical section shell 43 is at an angle to the axial direction C.

As shown in FIG. 4, a gap exists between an inner surface of the frame 10 and the conical section shell 43 of the impeller 40. During the operation of the diagonal fan DF, most air follows the path of the airflow AF, but some air leaks into said gap and creates a backflow. Said gap therefore forms a backflow channel 90.

Figure 5:
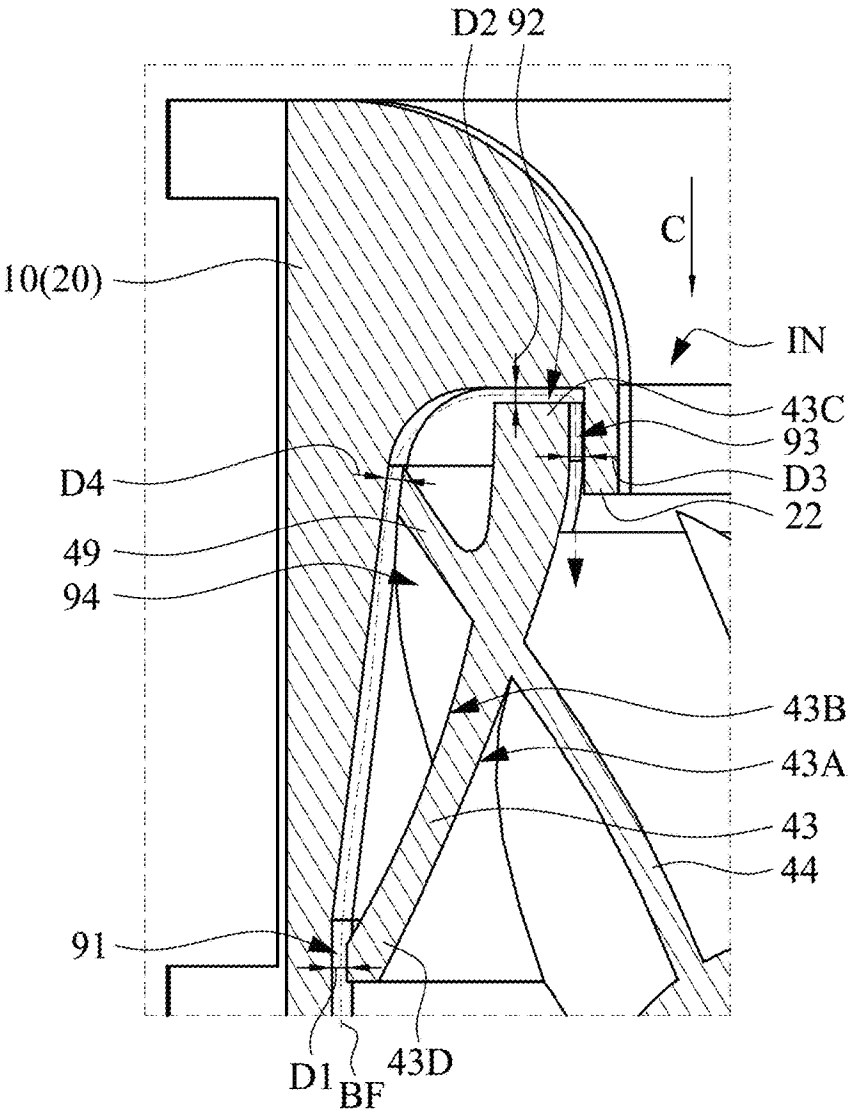
FIG. 5 is an enlarged view of the area BFC of FIG. 4.

Reference is made to FIG. 5. FIG. 5 is an enlarged view of the area BFC of FIG. 4. The backflow channel 90 is preferably curved or includes multiple non-parallel sections, so as to change the direction of airflow. In the present embodiment, the backflow channel 90 includes an intake section 91, a radial section 92, an exhaust section 93 and a curved section 94. The conical section shell 43 has a first rim 43C and a second rim 43D on opposite sides of the conical section shell 43. The first rim 43C is located at an upper end of the conical section shell 43 and is adjacent to the inlet IN. The second rim 43D is located at a lower end of the conical section shell 43 and is away from the inlet IN. The intake section 91 is located between the second rim 43D of the conical section shell 43 and the inner surface of the frame 10. The radial section 92 extends radially (i.e., substantially normal to the axial direction C) and is located between the first rim 43C of the conical section shell 43 and the inner surface of the frame 10. The exhaust section 93 is located between the first rim 43C of the conical section shell 43 and the guiding wall 22. The inner surface of the frame 10 has a curved region which faces the extended blades 49 and forms the curved section 94 between the intake section 91 and the radial section 92. In some embodiments, the backflow BF flows in a first direction in the intake section 91, and in the exhaust section 93, the backflow BF flows in a second direction opposite to the first direction. The flow resistance of the backflow channel 90 is thereby increased.

As shown in FIG. 5, the extended blades 49 of the impeller 40 project from the outer surface 43B of the conical section shell 43 and partially block the curved section 94 of the backflow channel 90. When the impeller 40 is rotating, the extended blades 49 create a pressure difference that serves to hinder the backflow BF. In addition, the extended blades 49 also cause an abrupt change of the direction of the backflow BF, causing the backflow BF to lose energy. As a result, backflow in the diagonal fan DF is reduced. With less backflow, the diagonal fan DF can achieve higher efficiency and produce less noise.

As shown in FIG. 5, in some embodiments, the intake section 91, the radial section 92 and the exhaust section 93 each has a constant width. For example, a distance D1 between the second rim 43D of the conical section shell 43 and the inner surface of the frame 10 can be constant, a distance D2 between an end surface at the first rim 43C of the conical section shell 43 and the inner surface of the frame 10 can be constant, and a distance D3 between the inner surface 43A of the conical section shell 43 and the guiding wall 22 can be constant. In addition, a distance D4 between an outer contour of the extended blade 49 and the inner surface of the frame 10 can be constant. By maintaining constant gap width between the impeller 40 and the frame 10, pressure distribution can be made more regular, and the characteristics of the diagonal fan DF can be improved accordingly. In some embodiments, the distances D1-D4 are substantially equal. In some embodiments, in order to effectively limit the backflow, the distances D1-D4 are less than or equal to 3 mm. In some embodiments, to prevent the conical section shell 43 from making contact with the frame 10 (e.g., due to mild vibration when the impeller 40 is rotating), the distances D1-D4 are at least 0.1 mm.

Figure 6:
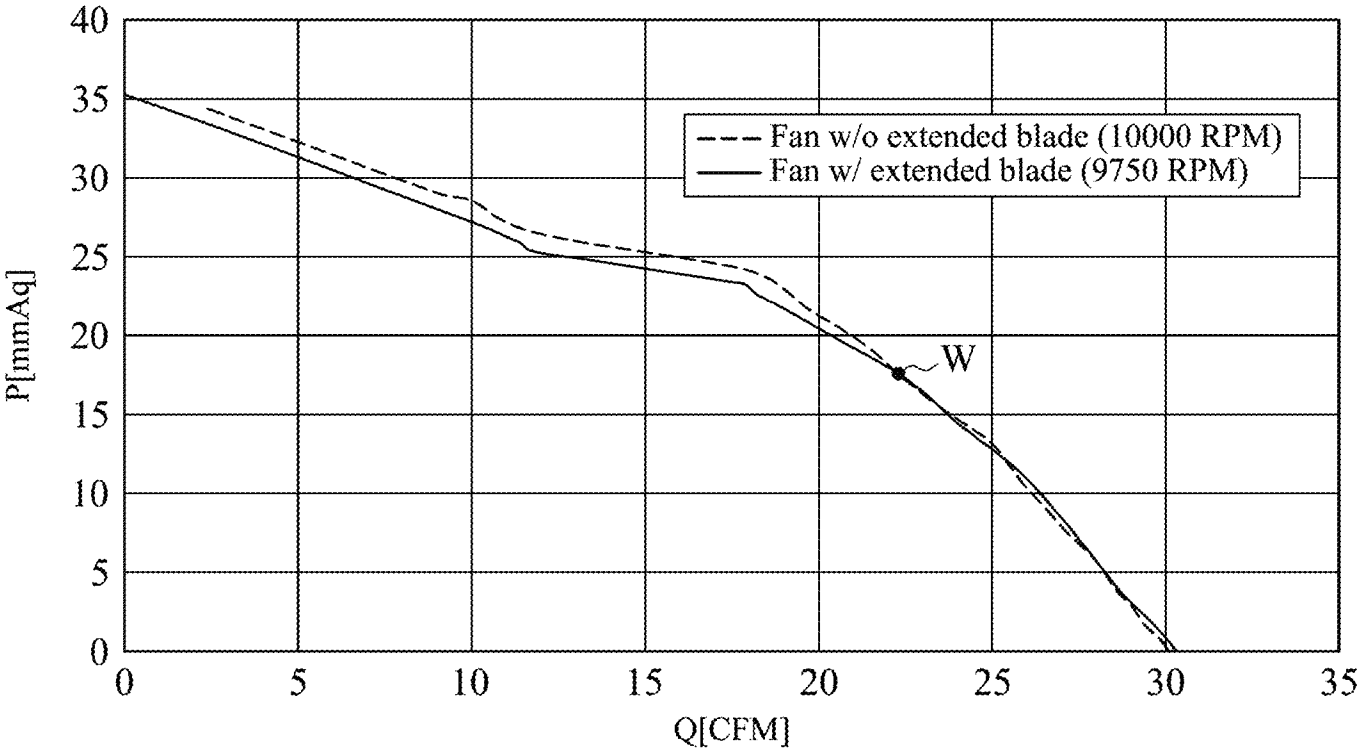
FIG. 6 illustrates a P-Q plot comparing the diagonal fan of the present disclosure to a conventional diagonal fan without extended blade.

Reference is made to FIG. 6. FIG. 6 illustrates a P-Q plot comparing the diagonal fan DF as described above to a conventional diagonal fan without extended blade. In the P-Q plot, the vertical axis indicates fan pressure, and the horizontal axis indicates flow rate. As shown in FIG. 6, with the extended blades 49, the diagonal fan DF can reach the operating point W at 9750 RPM. In contrast, without extended blade, the conventional fan needs to operate at 10000 RPM to reach the operating point W. In other words, the diagonal fan DF can reach the operating point W with 2.5% less speed. The fan efficiency is improved because the extended blades 49 can effectively reduce the backflow of air in the diagonal fan DF.

Figure 7:
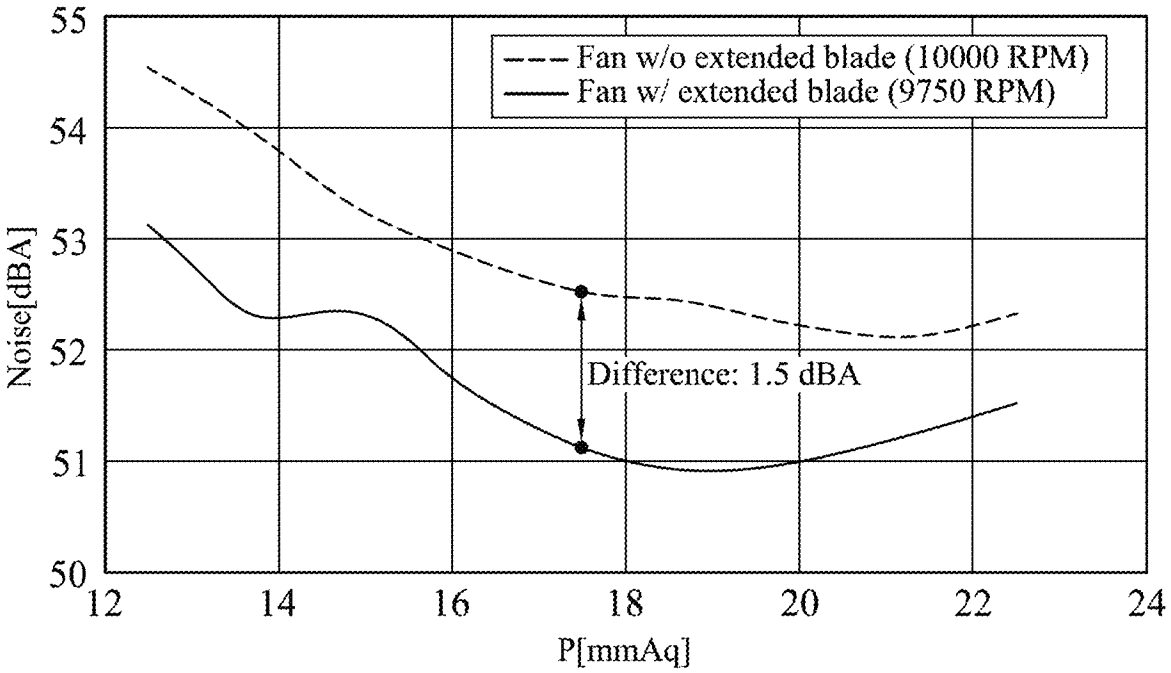
FIG. 7 illustrates an N-P plot comparing the diagonal fan of the present disclosure to a conventional diagonal fan without extended blade.

Reference is made to FIG. 7. FIG. 7 illustrates an N-P plot comparing the diagonal fan DF as described above to a conventional diagonal fan without extended blade. In the N-P plot, the vertical axis indicates noise level, and the horizontal axis indicates fan pressure. As shown in FIG. 7, compared to the conventional fan, the diagonal fan DF can achieve a maximum noise reduction of 1.5 dBA. The noise level is lowered because the extended blades 49 can effectively reduce the backflow of air in the diagonal fan DF, and also because that the diagonal fan DF with the extended blades 49 can operate at a lower speed as mentioned above.

Figure 8C:
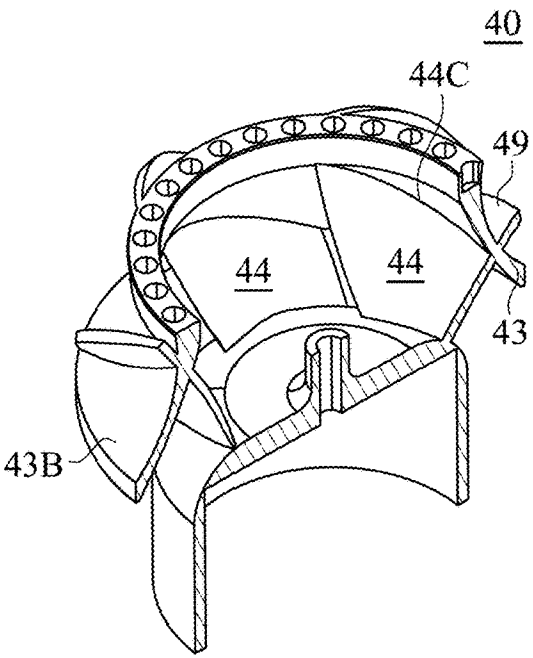
FIG. 8C illustrates a sectional view of the impeller shown in FIG. 8A.
Figure 8B:
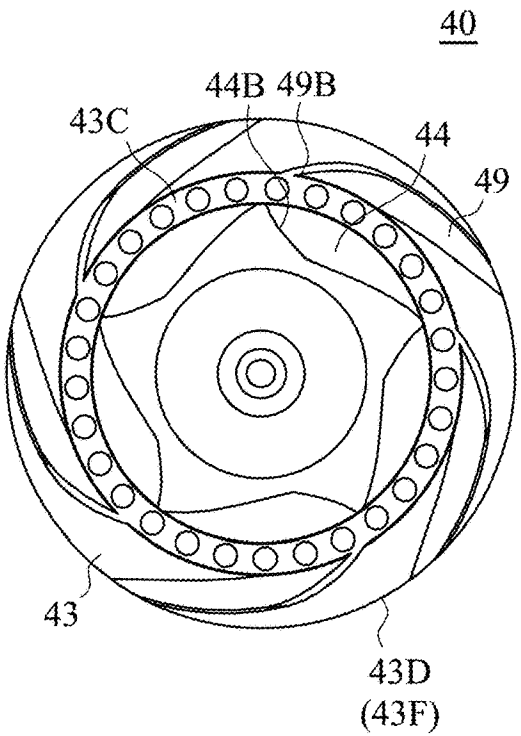
FIG. 8B illustrates a top view of the impeller shown in FIG. 8A.
Figure 8A:
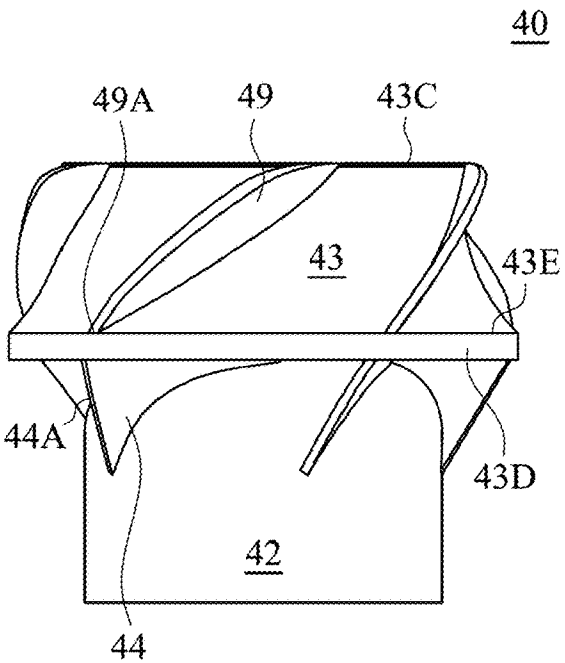
FIG. 8A illustrates a side view of the impeller shown in FIG. 3.

Reference is made to FIG. 8A. FIG. 8A illustrates a side view of the impeller 40 shown in FIG. 3. In some embodiments, each of the extended blades 49 extends from the first rim 43C to the second rim 43D of the conical section shell 43, and the two opposite ends of each extended blade 49 are joined with the first rim 43C and the second rim 43D, respectively. By this arrangement, the impeller 40 can maintain a constant gap width to the frame 10. In some embodiments, the impeller 40 includes an equal number of blades 44 and extended blades 49, and each of the extended blades 49 is aligned with one of the blades 44. In some embodiments, for an aligned pair of extended blade 49 and blade 44, a first end 49A of the extended blade 49 and an edge 44A of the blade 44 meets at the second rim 43D of the conical section shell 43. In some embodiments, the second rim 43D has a circular contour line 43E. In other words, the second rim 43D has a constant thickness.

Reference is made to FIG. 8B. FIG. 8B illustrates a top view of the impeller 40 shown in FIG. 8A. In some embodiments, for an aligned pair of extended blade 49 and blade 44, a second end 49B of the extended blade 49 and an edge 44B of the blade 44 meets at the first rim 43C of the conical section shell 43. In some embodiments, the second rim 43D has a circular contour line 43F. In other words, the second rim 43D has a constant diameter.

Reference is made to FIG. 8C. FIG. 8C illustrates a sectional view of the impeller 40 shown in FIG. 8A. In some embodiments, an orthogonal projection of the extended blade 49 onto the conical section shell 43 overlaps with an outer edge 44C of the blade 44. The extended blade 49 is effectively an extension of the blade 44 that protrudes out of the outer surface 43B of the conical section shell 43.

Figure 9C:
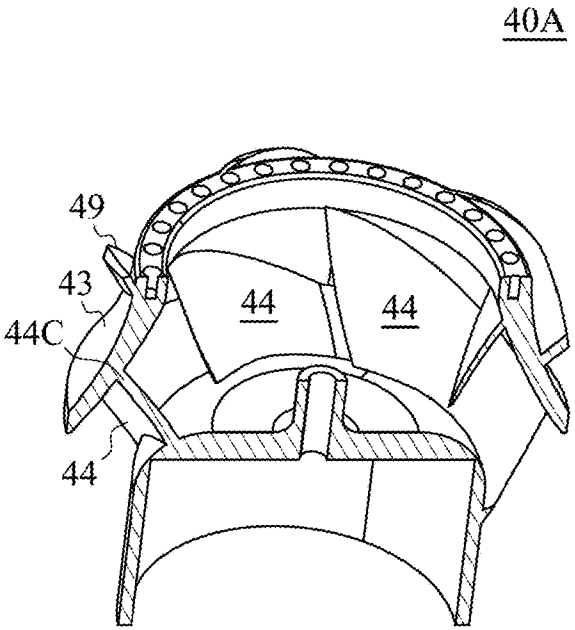
FIG. 9C illustrates a sectional view of the impeller shown in FIG. 9A.
Figure 9B:
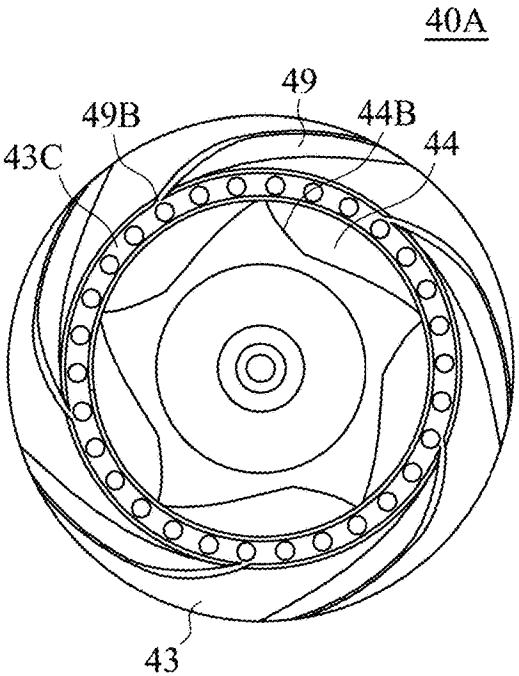
FIG. 9B illustrates a top view of the impeller shown in FIG. 9A.
Figure 9A:
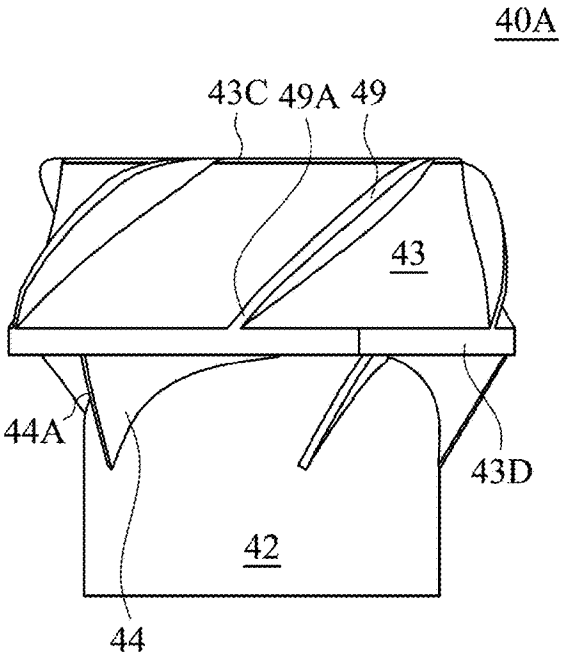
FIG. 9A illustrates a side view of an impeller in accordance with another embodiment of the present disclosure.

Reference is made to FIG. 9A. FIG. 9A illustrates a side view of an impeller 40A in accordance with another embodiment of the present disclosure. In the present embodiment, the extended blades 49 and the blades 44 are misaligned. In some embodiments, at the second rim 43D of the conical section shell 43, the first end 49A of the extended blade 49 is at an offset to the edge 44A of the blade 44.

Reference is made to FIG. 9B. FIG. 9B illustrates a top view of the impeller 40A shown in FIG. 9A. In some embodiments, in the misaligned configuration, the second end 49B of the extended blade 49 adjoining the first rim 43C of the conical section shell 43 is at an offset to the edge 44B of the blade 44.

Reference is made to FIG. 9C. FIG. 9C illustrates a sectional view of the impeller 40A shown in FIG. 9A. In some embodiments, an orthogonal projection of the extended blade 49 onto the conical section shell 43 does not fully overlap with the outer edge 44C of the blade 44.

Figure 10:
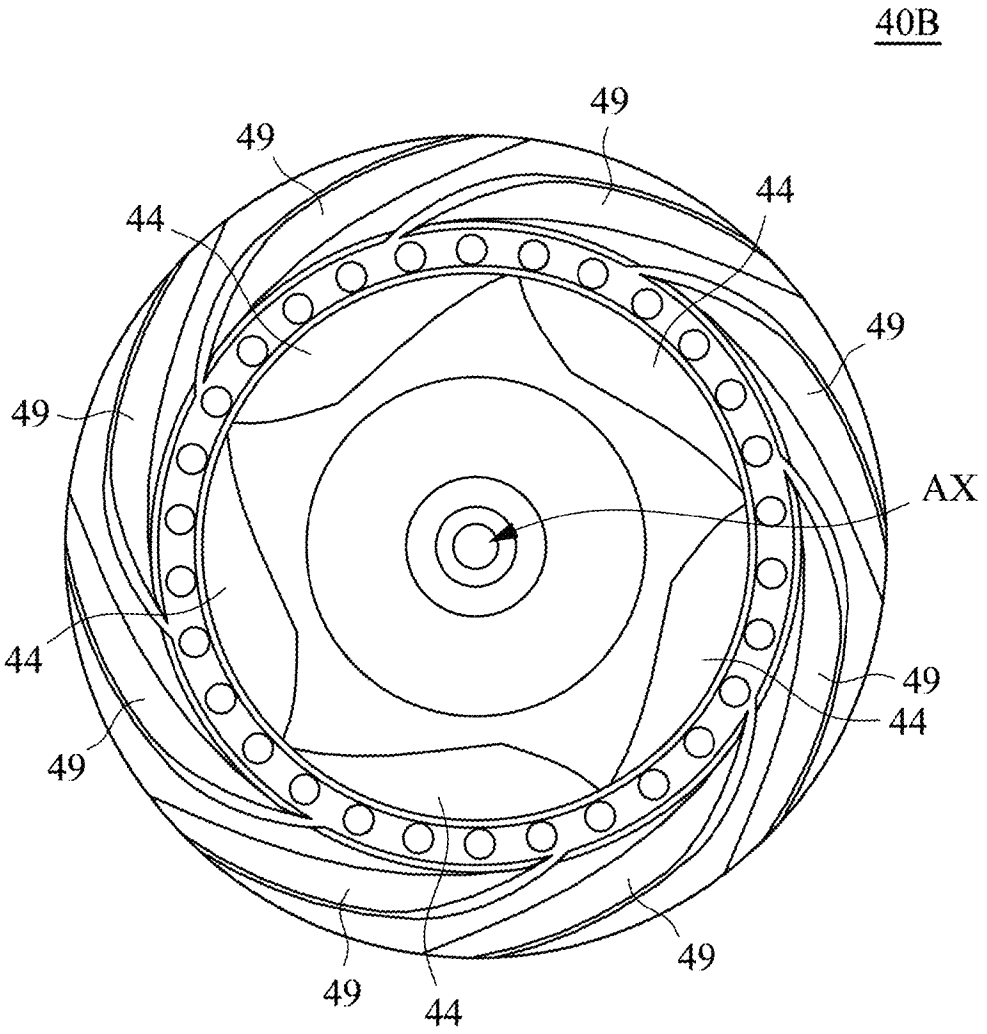
FIG. 10 illustrates a top view of an impeller in accordance with another embodiment of the present disclosure.

Reference is made to FIG. 10. FIG. 10 illustrates a top view of an impeller 40B in accordance with another embodiment of the present disclosure. The impeller 40B of the present embodiment has a different number of extended blades 49 and blades 44. In the illustrated embodiment, the impeller 40B includes more extended blades 49 than blades 44 (e.g., the impeller 40B may include eight extended blades 49 and five blades 44). The extended blades 49 are arranged symmetrically with respect to a central axis AX of the impeller 40B. In other embodiments, the impeller 40B may include fewer extended blades 49 than blades 44 (e.g., the impeller 40B may include less than five extended blades 49).

Figure 11:
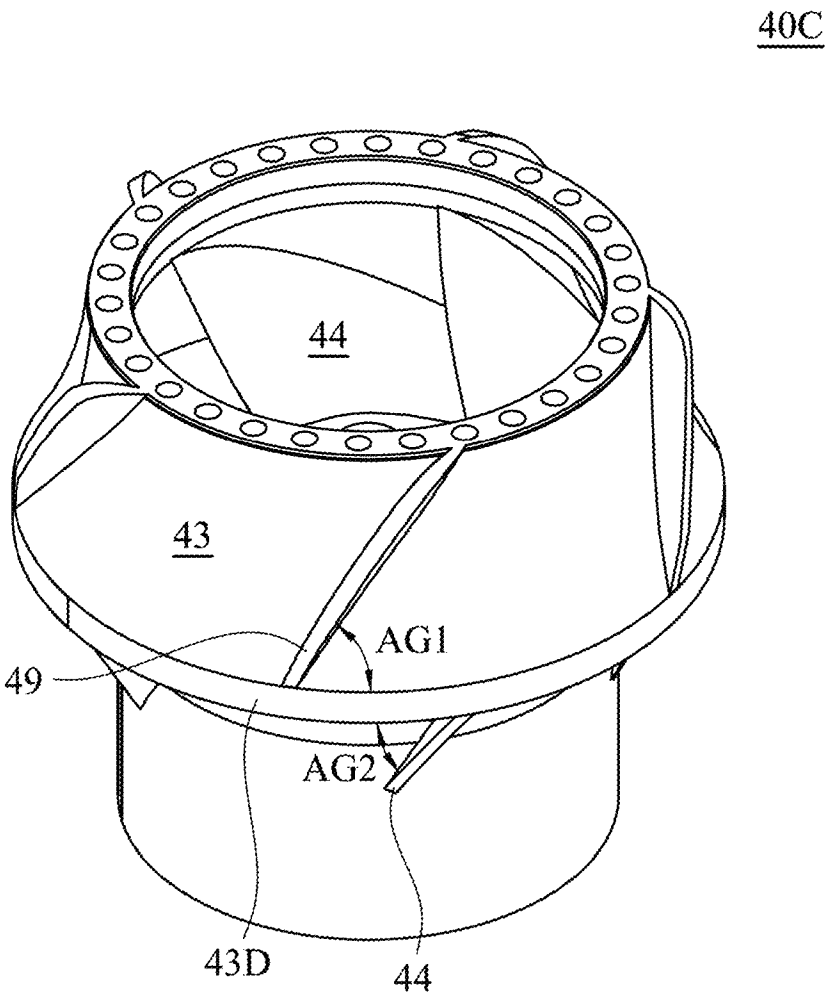
FIG. 11 illustrates a perspective view of an impeller in accordance with another embodiment of the present disclosure.

Reference is made to FIG. 11. FIG. 11 illustrates a perspective view of an impeller 40C in accordance with another embodiment of the present disclosure. In the impeller 40 of the previous embodiment, the extended blade 49 and the blades 44 are configured to have the same slope. However, other configurations are possible. As shown in FIG. 11, the extended blade 49 of the impeller 40C is at a first angle AG1 to the second rim 43D of the conical section shell 43, the blade 44 of the impeller 40C is at a second angle AG2 to the second rim 43D of the conical section shell 43, and the first angle AG1 can be different from the second angle AG2. The first angle AG1 may vary from 0 to 90 degrees.

Figure 12B:
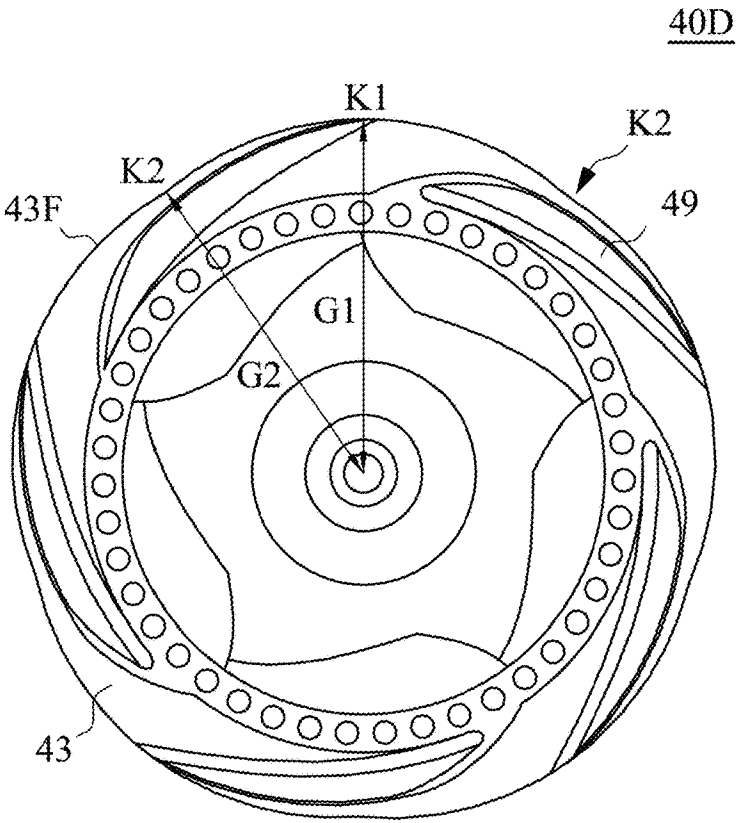
FIG. 12B illustrates a top view of the impeller shown in FIG. 12A.
Figure 12A:
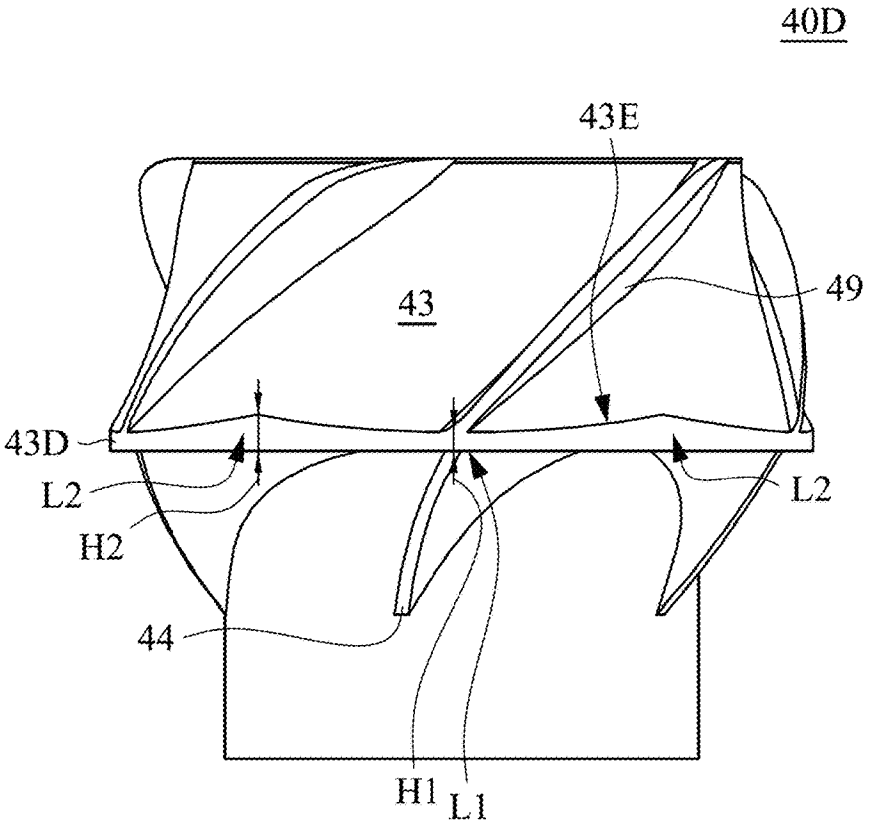
FIG. 12A illustrates a side view of an impeller in accordance with another embodiment of the present disclosure.

Reference is made to FIG. 12A. FIG. 12A illustrates a side view of an impeller 40D in accordance with another embodiment of the present disclosure. In the present embodiment, the second rim 43D of the conical section shell 43 has non-constant thickness. For example, the second rim 43D may have a first contour line 43E formed by a number of arcs connected together. The first contour line 43E has a first height H1 at a first location L1 (or more than one first locations L1) and a second height H2 at a different second location L2 (or more than one second locations L2). The second height H2 is different from the first height H1. In the present embodiment, the second height H2 is greater than the first height H1. The first location L1 can be the lowest point of the arc, and the second location L2 can be the highest point of the arc. The extended blade 49 and the blade 44 may be connected to the second rim 43D at the first location L1. Alternatively, the extended blade 49 and the blade 44 may be connected to the second rim 43D at other locations between two second locations L2.

Reference is made to FIG. 12B. FIG. 12B illustrates a top view of the impeller 40D shown in FIG. 12A. In some embodiments, the second rim 43D of the conical section shell 43 has non-constant diameter. For example, the second rim 43D may have a second contour line 43F formed by a number of arcs connected together. The second contour line 43F has a first diameter G1 at a first location K1 (or more than one first locations K1) and a second diameter G2 at a different, second location K2 (or more than one second locations K2). The second diameter G2 is different from the first diameter G1. In the present embodiment, the first diameter G1 is greater than the second diameter G2. The first location K1 can be the outermost point of the arc, and the second location K2 can be the innermost point of the arc. The extended blade 49 and the blade 44 may be connected to the second rim 43D at the first location K1. Alternatively, the extended blade 49 and the blade 44 may be connected to the second rim 43D at other locations between two second locations K2. In some embodiments, the first location K1 is the same location as the first location L1. In some embodiments, the second location K2 is the same location as the second location L2.

Figure 13:
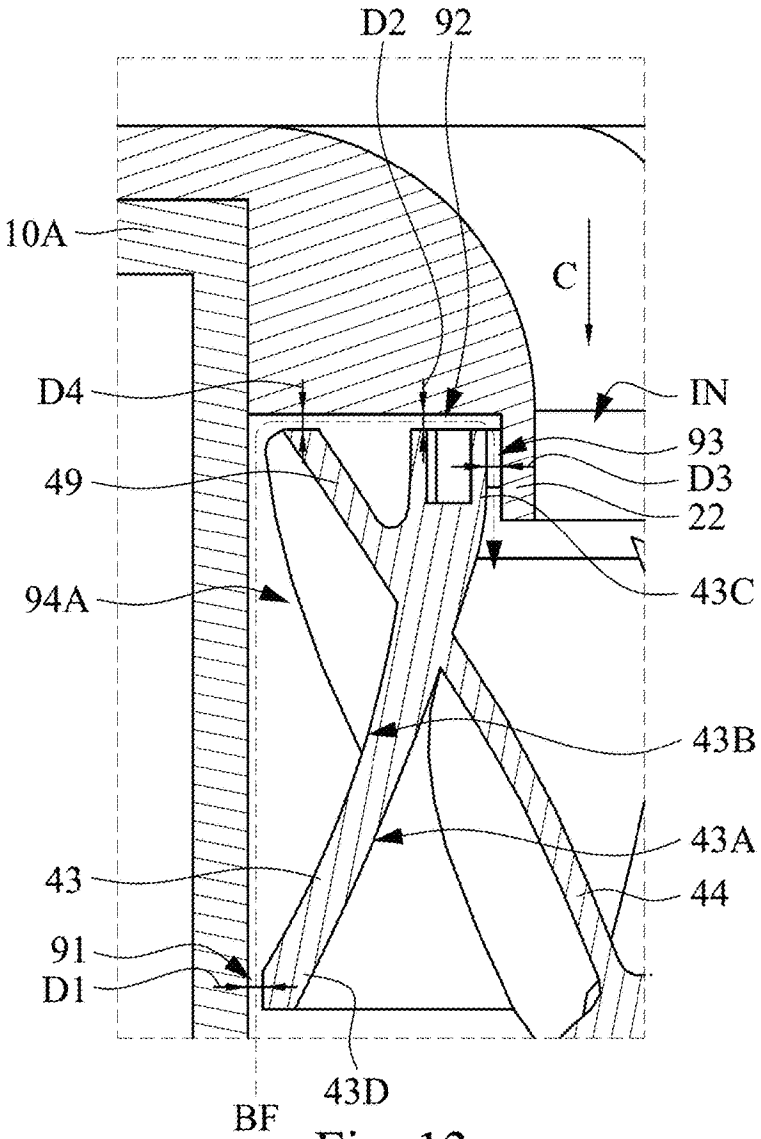
FIG. 13 illustrates a partial sectional view of a diagonal fan in accordance with another embodiment of the present disclosure.

Reference is made to FIG. 13. FIG. 13 illustrates another embodiment where the backflow channel has a different geometry. The backflow channel 90A of the present embodiment includes an intake section 91, a radial section 92, an exhaust section 93 and an angled section 94A. The conical section shell 43 has a first rim 43C and a second rim 43D on opposite sides of the conical section shell 43. The first rim 43C is adjacent to the inlet IN. The intake section 91 is located between the second rim 43D of the conical section shell 43 and an inner surface of the frame 10A. The radial section 92 is located between the first rim 43C of the conical section shell 43 and the inner surface of the frame 10A. The exhaust section 93 is located between the first rim 43C of the conical section shell 43 and the guiding wall 22. The inner surface of the frame 10 has a corner region (e.g., a corner having a right angle or other suitable angles) which faces the extended blades 49 and forms the angled section 94A is between the intake section 91 and the radial section 92. The extended blades 49 of the impeller 40 protrude out of the outer surface 43B of the conical section shell 43 and extend towards the angled section 94A to hinder the backflow BF.

As shown in FIG. 13, in some embodiments, the intake section 91, the radial section 92 and the exhaust section 93 each has a constant width. For example, a distance D1 between the second rim 43D of the conical section shell 43 and the inner surface of the frame 10A can be constant, a distance D2 between an end surface at the first rim 43C of the conical section shell 43 and the inner surface of the frame 10A can be constant, and a distance D3 between the inner surface 43A of the conical section shell 43 and the guiding wall 22 can be constant. In addition, a distance D4 between an outer contour of the extended blade 49 and the inner surface of the frame 10A can be constant. By maintaining constant gap width between the impeller and the frame 10A, pressure distribution can be more made regular, and the characteristics of the diagonal fan can be improved accordingly. In some embodiments, the distances D1-D4 are substantially equal. In some embodiments, the distances D1-D4 have each range from 0.1 mm to 3 mm.

Figure 14:
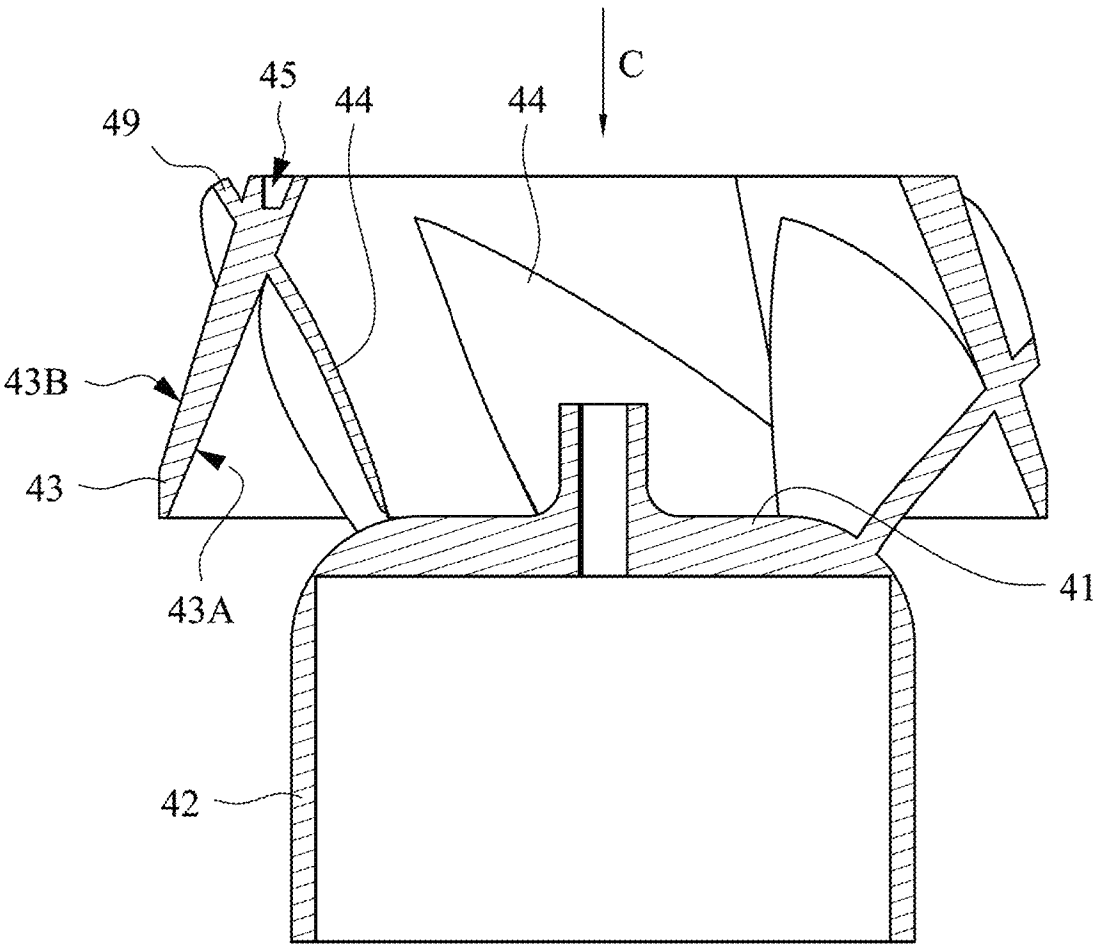
FIG. 14 illustrates a sectional view of an impeller in accordance with another embodiment of the present disclosure.

Reference is made to FIG. 14. FIG. 14 illustrates a sectional view of an impeller 40E in accordance with another embodiment of the present disclosure. The present embodiment differs from the embodiments described above in that the inner surface 43A and the outer surface 43B of the conical section shell 43 are generally flat and extend obliquely (i.e., the inner surface 43A and the outer surface 43B are at an angle to the axial direction C). Another difference is that the balance hole 45 for filing balancing weights has a non-constant diameter. Specifically, the diameter of the balance hole 45 has the greatest value at its opening, and reduces along the axial direction C. In some embodiments, an inner side of the balance hole 45 is inclined and is substantially parallel to the inner surface 43A of the conical section shell 43.

In sum, in the diagonal fan of the present disclosure, the conical section shell of the impeller is provided with one or more extended blades on its outer surface. The extended blades can obstruct backflow of air passing through the gap between the impeller and the frame of the fan. As a result, the efficiency of the diagonal fan is improved, and the noise produced by the diagonal fan can be reduced.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An impeller, comprising:

a hub;

a cylindrical part connected to the hub and extending axially from a lower end of the hub;

a conical section shell surrounding the hub;

a plurality of blades connected to the hub and an inner surface of the conical section shell, wherein the cylindrical part is free of coverage by the conical section shell, and each of the blades has an edge extending out of the conical section shell and towards the cylindrical part; and a plurality of extended blades disposed on an outer surface of the conical section shell and projecting from the outer surface of the conical section shell, wherein the extended blades are free of coverage by any part of the impeller, wherein the conical section shell comprises a first rim, the first rim is provided on one side of the conical section shell, each of the extended blades extends from the first rim, and one end of each of the extended blades is joined with the first rim.

2. The impeller of claim 1, wherein the conical section shell further comprises a second rim, the second rim is provided on an other side of the conical section shell, each of the extended blades extends from the first rim to the second rim, and two ends of each of the extended blades are joined with the first rim and the second rim, respectively.

3. The impeller of claim 1, wherein the blades and the extended blades are misaligned.

4. The impeller of claim 3, wherein the extended blades comprise a first extended blade, the blades comprise a first blade, the first extended blade and the first blade have the same slope, and the first extended blade is at an offset to the first blade.

5. The impeller of claim 3, wherein the impeller comprises a different number of extended blades and blades.

6. The impeller of claim 3, wherein the extended blades comprise a first extended blade, the blades comprise a first blade, the first extended blade and the first blade have different slopes.

7. The impeller of claim 1, wherein the first rim is located at a lower end of the conical section shell, and the first rim has a circular contour line.

8. The impeller of claim 1, wherein the first rim is located at a lower end of the conical section shell, and the first rim has a contour line formed by a number of arcs connected together.

9. An impeller, comprising:

a hub;

a cylindrical part connected to the hub and extending axially from a lower end of the hub;

a conical section shell surrounding the hub;

a plurality of blades connected to the hub and an inner surface of the conical section shell, wherein the cylindrical part is free of coverage by the conical section shell, and each of the blades has an edge extending out of the conical section shell and towards the cylindrical part; and a plurality of extended blades disposed on an outer surface of the conical section shell and projecting from the outer surface of the conical section shell, wherein the extended blades are free of coverage by any part of the impeller, wherein the impeller comprises an equal number of the blades and the extended blades, and each of the extended blades is aligned with one of the blades.

10. The impeller of claim 9, wherein the extended blades comprise a first extended blade, the blades comprise a first blade aligned with the first extended blade, wherein the first extended blade is an extension of the first blade.

11. The impeller of claim 9, wherein the extended blades comprise a first extended blade, the blades comprise a first blade, the first extended blade and the first blade have the same slope.

12. A diagonal fan, comprising:

a frame having an accommodation space, an inlet and an outlet; and an impeller disposed in the accommodation space and located between the inlet and the outlet, the impeller comprising:

a hub;

a cylindrical part connected to the hub and extending axially from a lower end of the hub;

a conical section shell surrounding the hub;

a plurality of blades connected to the hub and an inner surface of the conical section shell; and a plurality of extended blades disposed on an outer surface of the conical section shell and projecting from the outer surface of the conical section shell, wherein a backflow channel is created between the conical section shell and an inner surface of the frame, and the extended blades partially block the backflow channel.

13. The diagonal fan of claim 12, wherein a first distance between the inner surface of the frame and an outer contour of each of the extended blades is constant.

14. The diagonal fan of claim 13, wherein a second distance between a lower end of the conical section shell and the inner surface of the frame is constant, a third distance between an upper end of the conical section shell and the inner surface of the frame is constant, and the first distance is equal to the second distance and the third distance.

15. The diagonal fan of claim 14, wherein the frame comprises a guiding wall, the guiding wall is arranged around the inlet and extends towards the accommodation space, wherein a fourth distance between the upper end of the conical section shell and the guiding wall is constant and is equal to the first distance.

16. The diagonal fan of claim 12, wherein the inner surface of the frame has a curved region or a corner region facing the extended blades.

17. The diagonal fan of claim 12, wherein the conical section shell comprises a first rim and a second rim, the first rim and the second rim are provided on opposite sides of the conical section shell, each of the extended blades extends from the first rim to the second rim, and two ends of each of the extended blades are joined with the first rim and the second rim, respectively.

18. The diagonal fan of claim 12, wherein the extended blades comprise a first extended blade, the blades comprise a first blade aligned with the first extended blade, wherein the first extended blade is an extension of the first blade.

19. The diagonal fan of claim 12, wherein the extended blades comprise a first extended blade, the blades comprise a first blade, the first extended blade and the first blade have the same slope.

* * * * *